US011207552B2

(12) United States Patent
Gatsonides

(10) Patent No.: US 11,207,552 B2
(45) Date of Patent: Dec. 28, 2021

(54) FIRE SUPPRESSION SYSTEMS

(71) Applicant: Kidde Graviner Limited, Slough (GB)

(72) Inventor: Josephine Gatsonides, Dunstable (GB)

(73) Assignee: KIDDE GRAVINER LIMITED, Slough (GB)

( * ) Notice: Subject to any disclaimer, the term of this patent is extended or adjusted under 35 U.S.C. 154(b) by 151 days.

(21) Appl. No.: 15/293,932

(22) Filed: Oct. 14, 2016

(65) Prior Publication Data

US 2017/0106221 A1 Apr. 20, 2017

(30) Foreign Application Priority Data

Oct. 16, 2015 (GB) ..... 1518359

(51) Int. Cl.

| | |
|---|---|
| ***A62C 3/08*** | (2006.01) |
| ***A62C 35/68*** | (2006.01) |
| ***A62C 99/00*** | (2010.01) |
| ***A62C 35/02*** | (2006.01) |

(52) U.S. Cl.

CPC ..... *A62C 3/08* (2013.01); *A62C 35/02* (2013.01); *A62C 35/68* (2013.01); *A62C 99/0018* (2013.01)

(58) Field of Classification Search

CPC ..... A62C 3/08; A62C 35/02; A62C 35/68; A62C 99/0018; A62C 35/023; A62C 35/11; A62C 35/13; B64C 23/00; B60H 1/249; B60H 1/267; B60H 1/26; B64D 2045/009; B64D 13/04

USPC ..... 169/62

See application file for complete search history.

(56) References Cited

U.S. PATENT DOCUMENTS

| | | | | |
|---|---|---|---|---|
| 1,974,828 | A * | 9/1934 | Markut | A62C 99/009 128/200.28 |
| 2,424,764 | A * | 7/1947 | Marshall, Jr. | B64D 13/02 454/73 |
| 3,788,666 | A * | 1/1974 | Kramer | A62C 3/07 280/739 |
| 3,893,514 | A * | 7/1975 | Carhart | A62C 99/0018 169/46 |

(Continued)

FOREIGN PATENT DOCUMENTS

| | | | |
|---|---|---|---|
| EP | 2724753 | A2 | 4/2014 |
| EP | 2813266 | A2 | 12/2014 |
| WO | 2015119683 | A1 | 8/2015 |

OTHER PUBLICATIONS

Distributed. Collins English Dictionary—Complete and Unabridged, 12th Edition 2014. (1991, 1994, 1998, 2000, 2003, 2006, 2007, 2009, 2011, 2014). Retrieved Oct. 10, 2019 from https://www.thefreedictionary.com/distributed (Year: 2014).*

(Continued)

*Primary Examiner* — Alex M Valvis
*Assistant Examiner* — Christopher R Dandridge
(74) *Attorney, Agent, or Firm* — Cantor Colburn LLP

(57) ABSTRACT

A fire suppression system for an aircraft (cargo) compartment comprises a source of fire suppression agent and a supply line for conducting the fire suppression agent to the compartment. The supply line comprises a pressure regulating device arranged between the source and the compartment and a pressure relief valve arranged downstream of the pressure regulating device. The pressure relief valve has an outlet which distributes the agent externally of the cargo compartment.

18 Claims, 2 Drawing Sheets

(56) References Cited

U.S. PATENT DOCUMENTS 3,940,549 A * 2/1976 Whittum ..... C09D 4/06 428/500
4,432,514 A * 2/1984 Brandon ..... B64C 1/18 137/513.3
5,211,246 A * 5/1993 Miller ..... A62C 3/08 169/10
5,501,284 A * 3/1996 Clodfelter ..... A62C 99/0018 169/54
5,660,236 A * 8/1997 Sears ..... A62C 13/22 169/33
6,676,081 B2 1/2004 Grabow et al.
6,860,331 B2 * 3/2005 Hagen ..... A62C 35/68 169/16
8,678,101 B2 3/2014 Gatsonides et al.
8,813,858 B2 8/2014 Gatsonides et al.
2007/0079974 A1 * 4/2007 Thompson ..... A62C 3/07 169/62
2007/0125286 A1 6/2007 Lothe
2010/0089597 A1 * 4/2010 Neeb ..... A62C 37/10 169/37
2010/0170684 A1 * 7/2010 Richardson ..... A62C 35/02 169/46
2010/0187358 A1 * 7/2010 Voss ..... B64C 1/18 244/129.4
2010/0236796 A1 * 9/2010 Chattaway ..... A62C 37/44 169/46
2011/0048747 A1 3/2011 Gastonides
2011/0315406 A1 * 12/2011 Connery ..... A62C 37/14 169/16
2014/0110137 A1 * 4/2014 Ribarov ..... A62C 99/0018 169/44
2015/0184756 A1 7/2015 Palmqvist

OTHER PUBLICATIONS

Circumferentially, https://www.dictionary.com/browse/circumferential (2020). Retrieved Oct. 9, 2020 (Year: 2020).*
Spatial, https://www.merriam-webster.com/dictionary/spatial#:~:text=1%20%3A%20relating%20to%2C%20occupying%2C,of%20spatial%20ability%20spatial%20memory (Year: 2020).*
GB Search Report for Application No. GB1518359.3. dated Apr. 18, 2016. 3 Pages.
European Search Report for Application No. 16192417.0-1659 dated Feb. 27, 2017, 7 pages.

* cited by examiner

FIRE SUPPRESSION SYSTEMS

FOREIGN PRIORITY

This application claims priority to United Kingdom Patent Application No. GB 1518359.3 filed 16 Oct. 2015, the entire contents of which is incorporated herein by reference.

TECHNICAL FIELD

The present disclosure relates to fire suppression systems and in particular to fire suppression systems for aircraft.

BACKGROUND

Aircraft are typically provided with fire suppression systems, for example for providing fire suppression in cargo or other compartments of the aircraft. Most of these systems use Halon 1301 as a suppression agent. However, Halon 1301 destroys the ozone layer and is therefore being phased out of use. For example, the European Union now requires the introduction of environmentally friendly suppression agents in new aircraft from 2019 onwards. All aircraft will have to be Halon-free by 2040. The Federal Aviation Authority and the aircraft industry have selected and tested a number of Halon replacement agents.

Most of these alternative agents require a higher mass flow or volumes to be distributed in the protected enclosure. This may require that the suppression agent be stored at relatively high pressures. This in turn may require a flow control device such as a pressure regulation device and a pressure relief valve to be incorporated in the suppressant distribution system. Such an arrangement is disclosed, for example, in U.S. Pat. No. 8,678,101.

It has been recognised by the Applicant, however, that potential problems may arise in the practical implementation of such a system. This disclosure aims to address or mitigate such problems.

SUMMARY

From one aspect, the present disclosure provides a fire suppression system for an aircraft compartment, the system comprising a source of fire suppression agent; a supply line for conducting the fire suppression agent to the compartment; the supply line comprising a flow control device arranged between the source and the compartment and a pressure relief valve arranged downstream of the flow control device; the pressure relief valve having an outlet which distributes the agent externally of the compartment.

In an embodiment, the pressure relief valve discharges into a region of the aircraft between the compartment and the aircraft fuselage, for example into a bilge or cheek compartment.

The agent may be distributed along a length of the aircraft fuselage and/or circumferentially around the fuselage.

The outlet of the pressure relief valve may be of any construction which distributes the suppression agent.

In one embodiment, the outlet may comprise a plurality of discrete outlets.

In another embodiment, the outlet may comprise a perforated member such as a perforated tube or pipe.

In another embodiment, the outlet may comprise an elongate outlet such as a slot.

In another embodiment, the outlet may comprise a porous element, such as mesh element.

In another embodiment, the outlet may comprise a fabric element, for example a fire resistant fabric.

The fabric may be formed into a bag which is inflatable by the agent and through the wall of which the agent diffuses.

The disclosure also extends to a method of adapting a fire suppression system for an aircraft compartment comprising a source of fire suppression agent; a flow path for conducting the fire suppression agent to the compartment; the flow path comprising a flow control device arranged between the source and the compartment and a pressure relief valve arranged downstream of the flow control device, the method comprising providing the pressure relief valve with an outlet which distributes the agent externally of the compartment.

From a further aspect, the disclosure provides a method of providing fire protection for an aircraft compartment, comprising the step of venting fire suppression agent from an agent supply line through a pressure relief valve which discharges the agent in a distributed manner externally of the compartment.

BRIEF DESCRIPTION OF THE DRAWINGS

Embodiments of the disclosure will now be described, by way of example only, with reference to the accompanying drawings in which.

DETAILED DESCRIPTION

Figure 1:
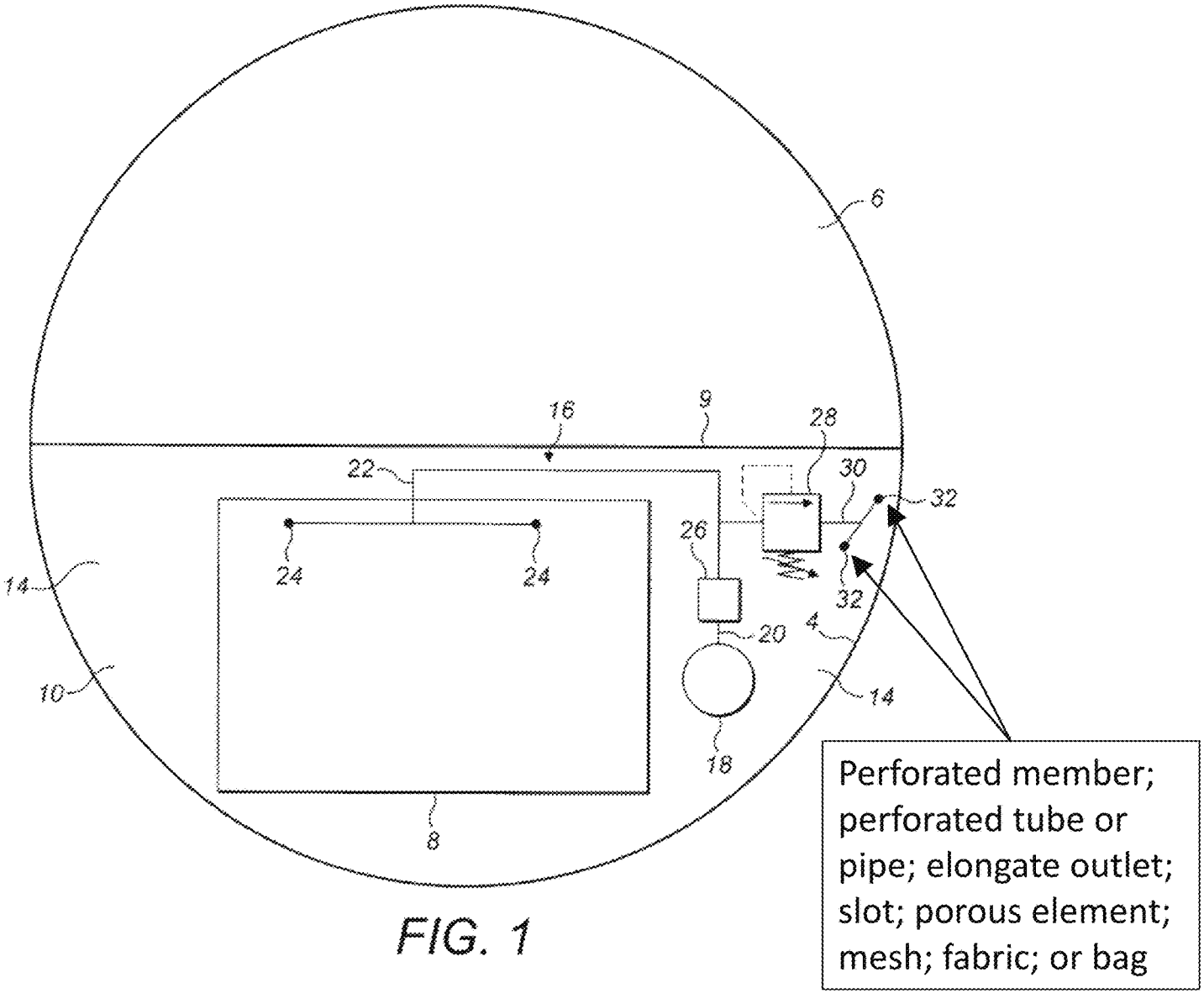
FIG. 1 is a schematic cross sectional view of an aircraft embodying a fire suppression system in accordance with this disclosure.

With reference to the Figures, an aircraft 2 comprises a fuselage 4 which includes an upper passenger compartment 6 and a lower cargo compartment 8 separated from the passenger compartment by a floor 9. The cargo compartment 8 is arranged within a lower space 10 of the fuselage 2. The lower space 10 has a bilge area 12 below the cargo compartment 8 and cheek areas 14 to the sides of the cargo compartment 8.

The cargo compartment 8 is provided with a fire suppression system 16. The fire suppression system 16 comprises a pressurised source 18 of a fire suppression agent such as argon, nitrogen, helium, carbon dioxide, heptafluoropropane or mixtures thereof. An agent supply line 20 leads to a low pressure distribution network 22 having, for example, one or more agent outlets 24 within the compartment 8.

A flow control device 26, for example a pressure regulating device is arranged in the supply line 20 between the high pressure agent source 18 and low pressure distribution network 22. The flow control device 26 reduces the flow of fire suppression agent from the agent source 18 to prevent an excessive pressure build-up within the compartment 8. The flow control device 26 can be of any suitable construction and may comprise a regulation device or a simple flow limiting device such as a flow limiting orifice.

In addition to the flow control device 26, a safety pressure relief valve 28 is fluidly connected to the supply line downstream of the flow control device 26 and in fluid communication with the low pressure distribution network 22. The pressure relief valve is configured to open above a pre-set pressure to relieve excessive pressure in the distribution network 22 to prevent damage to the cargo compartment 8. It may further be configured to close again once the pressure has returned to a safe value.

Figure 2:
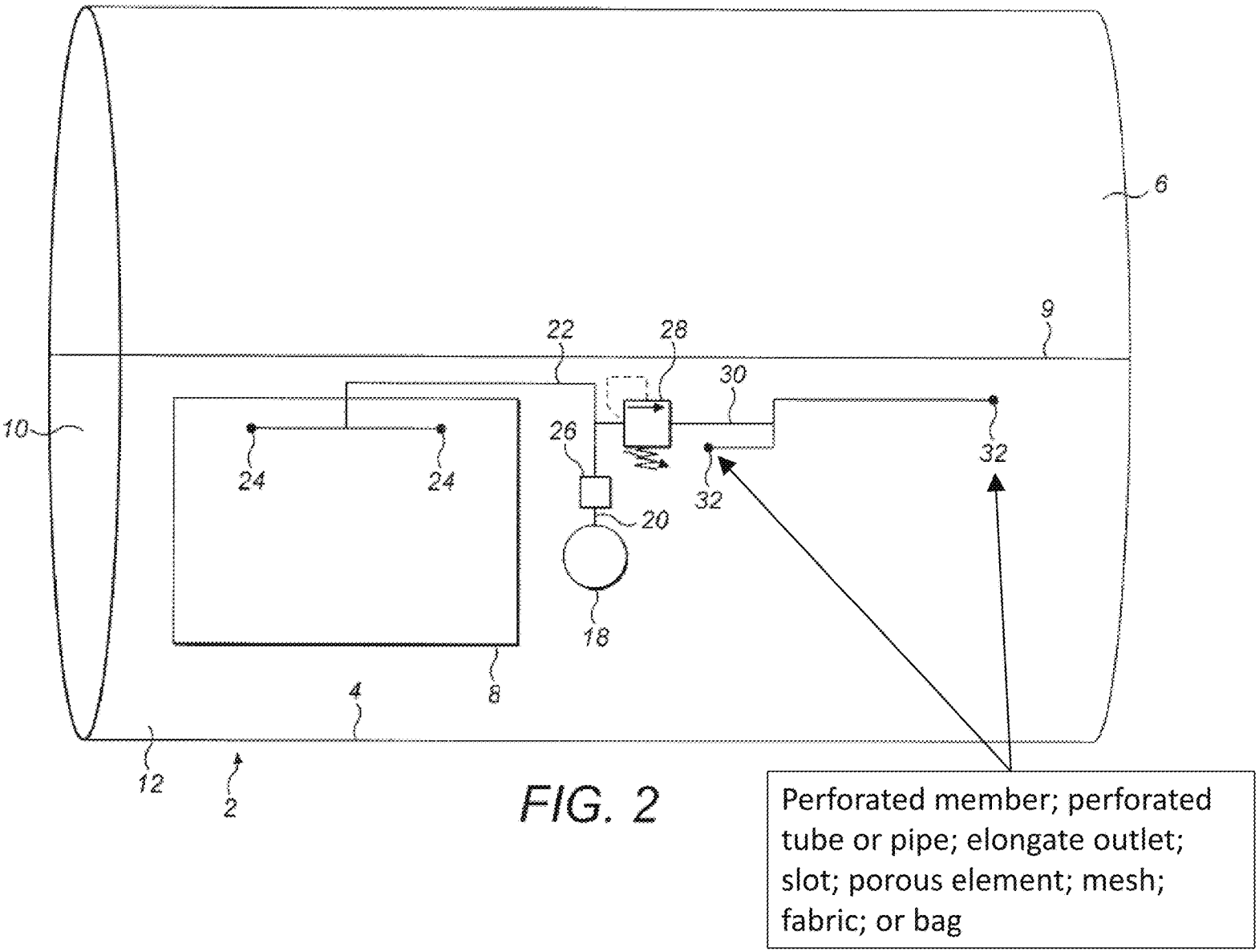
FIG. 2 is a schematic side view of an aircraft embodying an aircraft embodying a further fire suppression system in accordance with this disclosure

The pressure relief valve 28 has an outlet 30. The outlet 30 is arranged in the lower space 10 between the cargo compartment 8 and the fuselage 4. As illustrated in FIG. 1, the outlet 30 is arranged in one or more of the cheek areas 14, although it may be arranged in the bilge area 12, beneath the cargo compartment 8, or in an area 32 axially forward or rearward of the cargo compartment, as illustrated in FIG. 2, or even in a suitable location in the upper compartment 6 of the fuselage 4. The outlet 30 may be provided in a plurality of those areas.

The outlet 30 distributes the vented agent within the space 10 in such a manner as to avoid a localised high pressure which could damage the area, for example to a compartment liner or fuselage insulation. The agent may be distributed along a length of the fuselage 4 and/or circumferentially around the fuselage 4.

The outlet 30 may be designed in any manner to produce a distributed discharge. The outlet 30 may therefore have a plurality of discrete outlet ports 32, for example nozzles as illustrated.

In other embodiments, however, the outlet 30 may comprise a perforated member such as a perforated tube or pipe. In another embodiment, the outlet may comprise an elongate outlet such as a slot. In another embodiment, the outlet may comprise a porous element, for example a mesh element. In another embodiment, the outlet may comprise a porous fabric element, for example a fire resistant fabric. The fabric may be formed into an inflatable bag which inflates with agent and through which the agent may then diffuse.

It will be understood that the disclosure in its embodiments may provide the advantage of allowing a non Halon fire suppression agent which is stored at a higher pressure than Halon, to be used on an aircraft without potentially damaging the aircraft in the event of an excessive pressure, for example in the event of the failure of the flow control device 26.

Whilst disclosed in the context of protecting an aircraft cargo compartment, the disclosure also extends to protection of other compartments and enclosures within the aircraft fuselage 4. For example, the compartment may an electronics, avionics or auxiliary Power Unit (APU) compartment. The compartment may be in any part of the fuselage, as long as there is a space between the compartment and the fuselage into which the fire suppression agent may be vented in a distributed manner.

The invention claimed is:

1. A fire suppression system for an aircraft compartment, the system comprising:

a source of a fire suppression agent;

one or more agent outlets; and a supply line for conducting the fire suppression agent to the compartment through the one or more agent outlets;

the supply line comprising a flow control device arranged between the source and the compartment and a pressure relief valve arranged downstream of the flow control device;

the pressure relief valve having an outlet which produces a spatially distributed discharge of the fire suppression agent externally of the compartment to avoid a localized pressure that could damage an area into which the agent is discharged;

wherein the pressure relief valve comprises a single inlet for receiving the fire suppression agent and wherein the outlet comprises a plurality of discrete outlets that are spatially distributed over a larger area than the inlet area.

2. The fire suppression system of claim 1, wherein the pressure relief valve discharges into a region of the aircraft between the compartment and an aircraft fuselage of the aircraft.

3. The fire suppression system of claim 2, wherein the pressure relief valve discharges into a bilge or a cheek compartment of the aircraft fuselage.

4. The fire suppression system of claim 2, wherein the agent is distributed circumferentially around the fuselage.

5. The fire suppression system of claim 2, wherein the pressure relief valve discharges into a region beneath the compartment, or axially forward or rearward of the compartment, or into an upper compartment of the fuselage, or combinations thereof.

6. The fire suppression system of claim 1, wherein the outlet comprises a perforated member.

7. The fire suppression system of claim 6, wherein the outlet comprises a perforated tube or perforated pipe.

8. The fire suppression system of claim 1, wherein the outlet comprises an elongate outlet.

9. The fire suppression system of claim 8, wherein the outlet comprises a slot.

10. The fire suppression system of claim 1, wherein the outlet comprises a porous element.

11. The fire suppression system of claim 10, wherein the outlet comprises a mesh.

12. The fire suppression system of claim 1, wherein the outlet comprises a fabric.

13. The fire suppression system of claim 12, wherein the fabric is formed into a bag which is inflatable by the agent and through the wall of which the agent diffuses.

14. The fire suppression system of claim 12, wherein the fabric is a fire resistant fabric.

15. The fire suppression system of claim 1, wherein the fire suppression agent is a non-Halon fire suppression agent.

16. The fire suppression system of claim 15, wherein the non-Halon fire suppression agent comprises any of argon, nitrogen, helium, carbon dioxide, heptafluoropropane or mixtures thereof.

17. A method of adapting a fire suppression system for an aircraft compartment comprising a source of a fire suppression agent; one or more agent outlets, a flow path for conducting the fire suppression agent to the compartment through the one or more agent outlets; the flow path comprising a flow control device arranged between the source and the compartment and a pressure relief valve arranged downstream of the flow control device, the method comprising providing the pressure relief valve with an outlet which produces a spatially distributed discharge of the agent externally of the compartment to avoid a localized pressure that could damage an area into which the agent is discharged, wherein the pressure relief valve comprises a single inlet for receiving the fire suppression agent and wherein the outlet comprises a plurality of discrete outlets that are spatially distributed over a larger area than the inlet area.

18. A method of providing fire protection for an aircraft compartment by conducting fire suppression agent through an agent supply line to the compartment through one or more agent outlets within the compartment, comprising the step of venting fire suppression agent from the agent supply line through a pressure relief valve which discharges the agent in a spatially distributed manner externally of the compartment to avoid a localized pressure that could damage an area into which the fire suppression agent is discharged, wherein the pressure relief valve comprises a single inlet for receiving the fire suppression agent and wherein the outlet comprises a plurality of discrete outlets that are spatially distributed over a larger area than the inlet area.

* * * * *